United States Patent [19]

Esseniyi

[11] Patent Number: 4,585,024

[45] Date of Patent: Apr. 29, 1986

[54] AIR SHIFT CONVERSION APPARATUS FOR MANUAL VALVES

[75] Inventor: Alexander J. Esseniyi, Boardman, Ohio

[73] Assignee: Commercial Shearing, Inc., Youngstown, Ohio

[21] Appl. No.: 644,991

[22] Filed: Aug. 28, 1984

[51] Int. Cl.[4] ..... F15B 13/042

[52] U.S. Cl. ..... 137/269; 91/449; 92/131; 137/625.66; 251/31; 251/63.6

[58] Field of Search ..... 91/449; 137/269, 625.66; 251/31, 63.6; 92/59, 131

[56] References Cited

U.S. PATENT DOCUMENTS

| | | | |
|---|---|---|---|
| 3,875,849 | 4/1975 | Patel | 137/625.64 X |
| 4,011,891 | 3/1977 | Knutson et al. | 137/625.64 X |
| 4,290,447 | 9/1981 | Knutson | 137/625.64 X |
| 4,338,962 | 7/1982 | Turko et al. | 137/269 |
| 4,428,400 | 1/1984 | Tantardini | 137/625.64 X |
| 4,478,240 | 10/1984 | Tanner | 137/625.66 X |

*Primary Examiner*—Gerald A. Michalsky

*Attorney, Agent, or Firm*—Buell, Ziesenheim, Beck & Alstadt

[57] ABSTRACT

An air actuator device is provided for manually operable hydraulic valves having a valve spool moving in a bore in a valve housing in the form of an actuator housing adapted for attachment on the valve housing and having a bore carrying a piston coaxially engageable with the spool end, spaced openings in the actuator housing communicating with the bore therein to introduce air to act on opposite sides of the piston and resilient means on at least one side of the piston normally urging the piston and spool to a closed position.

8 Claims, 3 Drawing Figures

AIR SHIFT CONVERSION APPARATUS FOR MANUAL VALVES

This invention relates to air shift conversion kits for manual valves and particularly to a conversion kit which provides a complete air actuated assembly within a compact fully enclosed housing.

Hydraulic valves are made for many purposes and in many sizes and are usually made for manual operation. There are many instances where it would be desirable to convert such a manually operated valve to a fluid (e.g. air) operated valve so that it can be operated remotely. Typical of such installations are truck bed dump actuating valves and packer actuating valves on refuse trucks.

There have been attempts made to provide an air actuating system for such valves, however, they have met with application and reliability problems in the field. In general such systems include a number of elements such as an air cylinder, a coupling device between the air cylinder and the valve spool and a spring centering and detent device.

Such prior art devices have generally required that the entire air actuation mechanism be disassembled and reassembled in the field to make a field conversion. During such field conversion there is great difficulty in aligning the various elements with the valve spool and with each other so that they operate freely. Additionally the necessary assembly of these parts in sequence makes the entire assembly very long and subject to damage from mishandling or vibration as the valve is moved over rough or uneven terrain as in a truck or other vehicle. A third and important problem is that because such valves are frequently used under trucks, it is subject to corrosion and the accumulation of dirt that can cause the valve to malfunction.

The present invention provides a conversion kit which is compact and fully enclosed and thus free from any of the problems outlined above.

The present invention combines the necessary elements to provide air actuation in such a way that there are no moving elements exposed to the environment or that are located in cavities that are accessible to the atmosphere and are thus subject to having dirt and corrosive elements drawn into the cavity as the parts operate.

Another object of this invention is to arrange components so that they can be simply and reliably installed in the field with minimum likelihood that the entire device will malfunction due to incomplete assembly or misalignment by a minimally skilled technician or mechanic.

A further object of this invention is to provide a simple rugged mechanism that can be easily understood and serviced in the field.

I provide generally an air actuator device for manually operable valves having a valve spool moving longitudinally in a bore in a valve housing said spool having an engagement means at one end for engagement by a manual actuator, said air actuator comprising piston means engageable on the engagement means of said spool end, an actuator housing having a generally cylindrical bore surrounding said piston means and spool end and adapted to be engaged with the valve housing, spaced openings in said actuator housing communicating with the said bore whereby control air may be introduced into said bore to act on opposite sides of said piston means and resilient means on at least one side of said piston normally urging said piston and the valve spool to a closed position. Normally, a manually operable spool valve has a transverse opening at one end of the valve spool through which a pin passes to engage a manually operated lever. Preferably the piston here has a corresponding opening and a pin is passed through the piston opening and spool end opening to provide the engagement means between the two. Preferably the actuator housing is sealingly attached to the valve housing by means of a resilient seal such as an elastomer O-ring and capscrews. The resilient means acting on the piston is preferably a spring surrounding the piston.

In the foregoing general description of this invention I have set out certain objects, purposes and advantages of the invention.

Other objects, purposes and advantages of this invention will be apparent from a consideration of the following description and the accompanying drawings in which.

Figure 1:
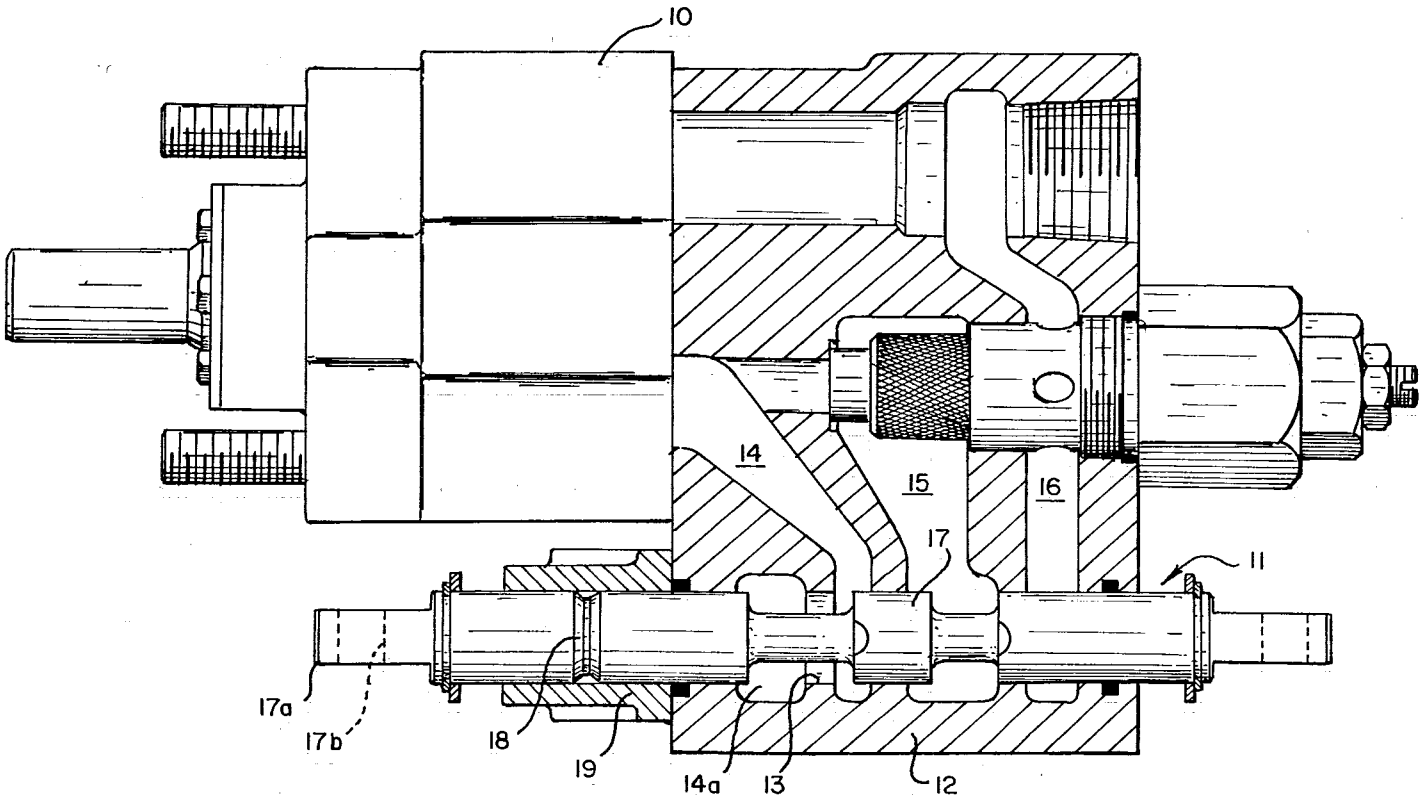
Fig. 1. (Prior Art)
FIG. 1 is a side elevational view partly in section of a typical prior art valve assembly for a truck bed dumping hoist.

Referring to the drawings, I have illustrated in FIG. 1 a normal hydraulic pump 10 and valve 11 assembly for a hydraulic hoist control for a truck dump bed assembly. The valve 11 is made up of housing 12 having a longitudinal bore 13 intersecting side by side control chambers 14, 14*a*, 15 and 16. A valve spool 17 is movable longitudinally in bore 13 by means of a manual lever (not shown) connected to one end 17*a* of spool 17 by means of a pin (not shown) extending through opening 17*b* in said one end of spool 17. Spool 17 is provided with a detent groove 18 adjacent said one end 17*a* surrounded by a detent housing 19 fixed to housing 12 by capscrews.

Figure 2:
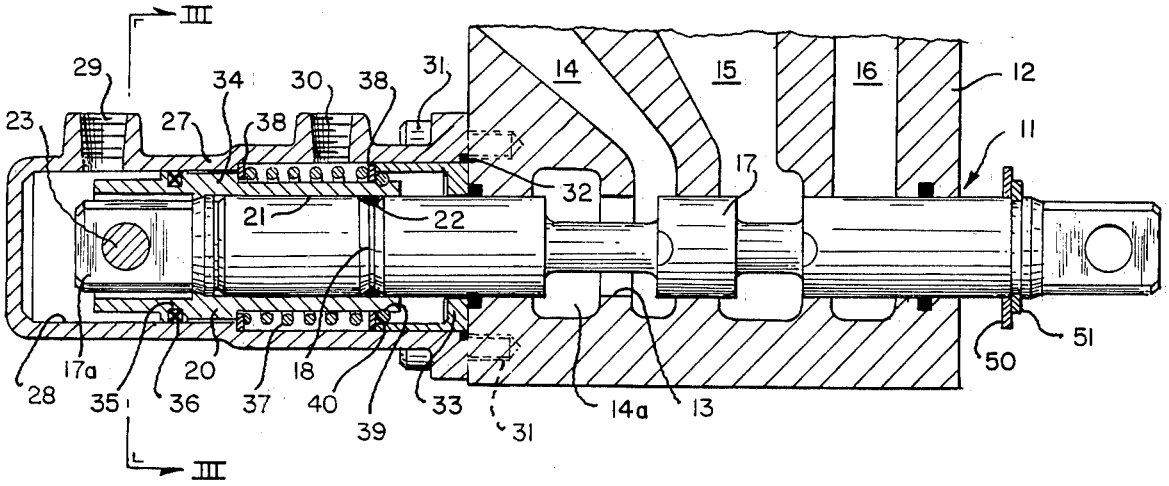
FIG. 2 is an enlarged sectional view of the air actuator device of this invention attached to a valve assembly such as shown in FIG. 1.
Figure 3:
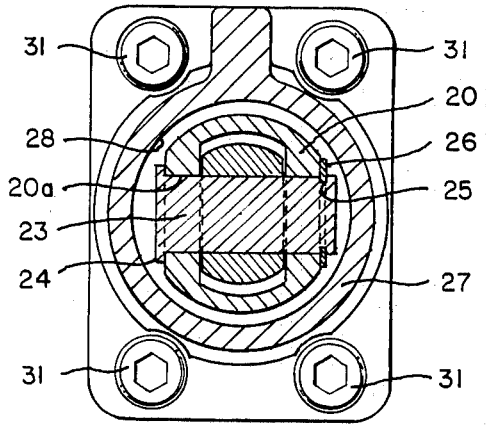
FIG. 3 is a section on the line III—III of FIG. 2.

In FIG. 2, I have illustrated the air actuator of my invention assembled on a valve assembly such as that of FIG. 1. The actuator includes a piston 20 having a central bore 21 slidable over the end 17*a* of valve spool 17 to a point beyond detent groove 18 which is provided with an elastomer seal 22 between the spool 17 and piston 20 in groove 18. Piston 20 is provided with an opening 20*a* corresponding to opening 17*b* of the valve spool through which a connector or clevis pin 23 passes. Connector or clevis pin 23 has a flanged head 24 at one end and a groove 25 at the other receiving a retainer ring 26 to hold the pin in place. Piston 20 is surrounded by a housing 27 which has a longitudinal bore 28 surrounding the piston and spool end and two spaced inlet openings 29 and 30 along its length. The housing 27 replaces detent housing 19 of FIG. 1 and is held in place on valve housing 12 by capscrews 31. Housing 27 is preferably sealed to housing 12 by an elastomer seal ring 32 such as an O-ring. Within bore 28 and surrounding spool end 17 and one end of piston 20 is a spring spacer member 33. Intermediate the ends of piston 20 between inlets 29 and 30 is an annular flange 34 having a groove 35 carrying a seal 36 which engages the wall of bore 28. A spring 27 surrounds one end of piston 20 between spring spacer member 33 and flange 34 and is held in position by retainer rings 38 at each end. Piston 20 is provided with a groove 39 carrying a stop ring 40 at the end adjacent spacer member 33. The operation of the actuator of this invention is as follows. When air pressure is ported to port 30 and exhausted from port 29 the valve spool 17 is moved to the left compressing spring 37. Spool 17 is stopped against retaining rings 50, 51 on the opposite end of the spool (see FIG. 1). When air is directed into port 29 and exhausted from port 30, the valve spool 17 is moved to the right, compressing the spring 37. The spool is stopped by piston 20 moving against the spring spacer member 33.

When both ports 29 and 30 are exhausted spring 37 returns the spool 17 from either the left or right position and detents it at center.

In the foregoing specification I have set out certain preferred practices and embodiments of my invention, however, it will be understood that this invention may be otherwise embodied within the scope of the following claims.

I claim:

1. An air actuator device for manually operable hydraulic valves having a valve spool moving longitudinally in a bore in a valve housing, said spool having an integral engagement means at one end for normal engagement by a manual actuator comprising piston means surrounding the engagement means of said spool end, fastener means fastening said piston means surrounding said engagement means, an actuator housing having a cylindrical bore surrounding and slidably receiving said piston means and spool end and adapted to be fixed on the valve housing around the piston means, spaced openings in said actuator housing communicating with said bore whereby control air may be introduced into said bore to act on opposite side of said piston means and resilient means surrounding a portion of said piston normally urging said piston and the valve spool to a closed position.

2. An air actuator device as claimed in claim 1 wherein the piston means is removably fastened to the end of the valve spool by means of a clevis pin through holes in each of the piston and valve spool end.

3. An air actuator device as claimed in claim 1 or 2 wherein the resilient means is a spring.

4. An air actuator device as claimed in claim 1 or 2 wherein the resilient means is a spring surrounding a reduced portion on one side of said piston means.

5. An air actuator device as claimed in claim 4 wherein the piston means is hollow and sealingly surrounds the end of said spool having the engagement means.

6. An air actuator as claimed in claim 5 wherein the spool end has a detent groove adjacent the engagement end and an O-ring seal in said detent groove sealingly engaging the interior of the piston means.

7. An air actuator device as claimed in claim 1 or 2 wherein the piston means is hollow and sealingly surrounds the end of said spool having the engagement means.

8. An air actuator device as claimed in claim 7 wherein the spool end has a detent groove adjacent the engagement end and an O-ring seal in said detent groove sealingly engaging the interior of the piston means.

* * * * *